US005856268A

United States Patent [19]

Takao

[11] Patent Number: 5,856,268

[45] Date of Patent: Jan. 5, 1999

[54] HEAT TRANSFER IMAGE-RECEIVING SHEET

[75] Inventor: Shino Takao, Tokyo-To, Japan

[73] Assignee: Dai Nippon Printing Co., Ltd., Japan

[21] Appl. No.: 539,654

[22] Filed: Oct. 5, 1995

[30] Foreign Application Priority Data

Oct. 6, 1994 [JP] Japan ..... 6-268354

[51] Int. Cl.[6] ..... B41M 5/035; B41M 5/38

[52] U.S. Cl. ..... 503/227; 428/195; 428/423.1; 428/447; 428/480; 428/913; 428/914

[58] Field of Search ..... 8/471; 428/195, 428/447, 913, 914, 423.1, 480; 503/227

[56] References Cited

FOREIGN PATENT DOCUMENTS

| | | | |
|---|---|---|---|
| 0 402 786 | 12/1990 | European Pat. Off. | 503/227 |
| 0 600 424 A1 | 6/1994 | European Pat. Off. | 503/227 |

OTHER PUBLICATIONS

Patent Abstracts of Japan, vol. 11, No. 114, 10 Apr. 1987 & JP-A-61 258792, 17 Nov. 1986, Abstract.

*Primary Examiner*—Bruce H. Hess
*Attorney, Agent, or Firm*—Parkhurst & Wendel, L.L.P.

[57] ABSTRACT

There is provided a heat transfer image-receiving sheet comprising: a substrate sheet, end a dye-receiving layer provided at least on one surface of the substrate sheet, comprising a thermoplastic resin and at least two types of cured products of modified silicones whose curing mechanisms are different.

There is also provided a heat transfer image-receiving sheet comprising: a substrate sheet, a dye-receiving layer provided at least on one surface of the substrate sheet, comprising a thermoplastic resin, and a releasing layer provided on the dye-receiving layer, comprising at least two types of cured products of modified silicones whose curing mechanisms are different.

21 Claims, No Drawings

HEAT TRANSFER IMAGE-RECEIVING SHEET

BACKGROUND OF THE INVENTION

1. Field of the Invention

The present invention relates to a heat transfer image-receiving sheet. More particularly, the present invention relates to a heat transfer image-receiving sheet which is highly releasable from a heat transfer sheet without being thermally fused therewith when an image is formed and on which a deeply-dyed image can be formed.

2. Background Art

Heretofore, a variety of heat transfer printing methods have been known. One of them is a method in which a sublimable dye is thermally transferred from a heat transfer sheet in which the sublimable dye is supported as a recording agent on a substrate sheet such as a polyester film to an image-receiving sheet capable of being dyed with the sublimable dye, prepared, for example, by providing a dye-receiving layer on paper or a plastic film, thereby producing various full-colored images on the image-receiving sheet.

In the above printing method, the thermal head of a printer is employed as a heat application means, and a large number of dots in three or four colors, the amount of heat applied thereto being properly controlled, are transferred to the image-receiving sheet in an extremely short heat application time. A full-colored original image can thus be successfully reproduced by the multicolored dots on the image-receiving sheet.

The above-obtained image is very sharp and excellent in transparency because a dye is used as the recording agent. The printing method of this type can thus produce an image excellent in the reproduction of half-tones and also in gradation, comparable to an image obtainable by conventional offset printing or gravure printing. Moreover, the quality of the image is as high as that of a full-colored photograph.

Upon effectively conducting the above heat transfer printing, not only the structure of the heat transfer sheet but also that of the image-receiving sheet on which an image is formed is important. Conventionally-known image-receiving sheets are those disclosed, for instance, in Japanese Laid-Open Patent Publications Nos. 169370/1982, 207250/1982 and 25793/1985, in which image-receiving sheets are prepared by providing a dye-receiving layer, using a resin selected from polyester resins, vinyl resins such as polyvinyl chloride resin, polycarbonate resins, polyvinyl butyral resins, acrylic resins, cellulose resins, olefin resins, polystyrene resins and the like.

In the case where the above-described heat transfer image-receiving sheets have an image-receiving surface which is poor in release properties, they are thermally fused with a heat transfer sheet due to heat which is applied by a thermal head when an image is formed. A loud noise is therefore made when the image-receiving sheet is separated from the heat transfer sheet. Moreover, troubles called abnormal transfer printing are caused; for instance, the dye layer of the heat transfer sheet is entirely transferred to the image-receiving sheet, and the dye-receiving layer of the image-receiving sheet is separated from the substrate A method in which various releasing agents are incorporated into the dye-receiving layer, and a method in which a releasing layer Is separately provided on the dye-receiving layer have been conventionally known as the methods for solving the above-described problems in the release properties. Among various releasing agents, silicone compounds such as silicones and silicone resins are effective for imparting release properties, and modified silicones which can be cured are particularly effective.

Among curing-type silicones, addition-polymerizable silicones, condensation-polymerizable silicones and active-energy-ray-curing silicones are presently known well. These silicones are added as silicone oils, and cured by the application of heat or active energy rays. Release properties can thus be obtained.

However, these cured silicones have, depending upon the type thereof, a problem in mar resistance, that is, during the transportation of a heat transfer image-receiving sheet having a dye-receiving layer into which any of the above silicones is incorporated, the dye-receiving layer is rubbed with the back surface of another piece of the heat transfer image-receiving sheet and marred, so that the image-receiving sheet cannot fully exhibit release properties when heat transfer printing is conducted; and a problem of heavy separation, that is, it becomes heavy to separate the image-receiving sheet from a heat transfer sheet when an image is formed.

Further, a cured product which is obtained by the reaction between an amino-modified silicone and an epoxy-modified silicone has also been known well. However, the separation of an image-receiving sheet comprising such a cured product from a heat transfer sheet is heavier then that of an image-receiving sheet comprising a cured product of an addition-polymerizable silicone, a condensation-polymerizable silicone or an active-energy-ray-curing silicone. In addition, it takes time to cure amino- and epoxy-modified silicones.

In order to obtain satisfactory release properties by the use of a curing-type modified silicone oil selected from the above-described addition-polymerizable silicones, condensation-polymerizable silicones, active-energy-ray-curing silicones, and amino- and epoxy-modified silicones, it is effective to add a large amount of the silicone oil to a dye-receiving layer, or to provide a thick releasing layer. However, in either of these cases, the dyeability of a dye used is impaired, and, as a result, an image having a high density cannot be obtained. Further, even if the amount of the silicone oil used is made large, or even if the releasing layer is made thick, the above-described mar resistance or anti-heavy separation properties cannot be improved depending upon the type of the resin used for forming the dye-receiving layer.

In order to improve the mar resistance, it is preferable to obtain release properties by reacting a silicone oil having active hydrogen such as a hydroxyl-modified silicone, a carboxyl-modified silicone or an amino-modified silicone with a curing agent such as an isocyanate compound or an organometallic compound, thereby curing the silicone.

However, In the above reaction, it is necessary to conduct baking at a high temperature for many hours, and also to conduct aging for a long time after the step of drying. The above reaction thus requires many hours, so that it is disadvantageous from the viewpoint of productivity. On the other hand, when baking is conducted at a low temperature for a short time, there may be a case where release properties cannot be fully obtained even if aging is conducted thereafter. Further, if the amount of the curing agent or that of a catalyst is increased to such an extent that release properties can be fully obtained, the pot life of a coating liquid becomes extremely short. The coating liquid is therefore gelled before it is coated, or the coatability thereof becomes worse.

Accordingly, an object of the present invention is to solve the aforementioned problems, thereby providing a heat transfer image-receiving sheet which is highly releasable from a heat transfer sheet and on which a high-density image can be recorded.

SUMMARY OF THE INVENTION

To achieve the above object, the present invention provides a heat transfer image-receiving sheet which comprises a substrate sheet, and a dye-receiving layer provided at least on one surface of the substrate sheet, comprising a thermoplastic resin and at least two types of cured products of modified silicones whose curing mechanisms are different.

The present invention also provides a heat transfer image-receiving sheet which comprises a substrate sheet, a dye-receiving layer provided at least on one surface of the substrate sheet, comprising a thermoplastic resin, and a releasing layer formed on the dye-receiving layer, comprising at least two types of cured products of modified silicones whose curing mechanisms are different.

According to the present invention, since two or more curing-type modified silicones are used, the shortcomings of one curing-type modified silicone can be offset by the other curing-type modified silicone(s), and, in addition to this, a dye-receiving layer imparted with the advantageous properties of the two or more silicones used can be obtained.

The dye-receiving layer or the releasing layer formed has excellent release properties. In addition, since the layers can be obtained by conducting drying at a low temperature, the substrate sheet is scarcely affected by heat. Therefore, the substrate sheet is neither thermally shrunk nor roughened. Moreover, the drying can be conducted in a short time, so that the heat transfer image-receiving sheet can be obtained with high productivity.

DETAILED DESCRIPTION OF THE INVENTION

The heat transfer image-receiving sheet of the present invention will now be described in detail.

The heat transfer image-receiving sheet of the present invention comprises a substrate sheet, and a dye-receiving layer formed at least on one surface of the substrate sheet, comprising a thermoplastic resin and at least two types of cured products of modified silicones whose curing mechanisms are different According to another embodiment of the present invention, the heat transfer image-receiving sheet comprises a substrate sheet, a dye-receiving layer formed at least on one surface of the substrate sheet, comprising a thermoplastic resin, and a releasing layer formed on the dye-receiving layer, comprising at least two types of cured products of modified silicones whose curing mechanisms are different.

Substrate Sheet

The substrate sheet is of use to support thereon the dye-receiving layer. Since the substrate sheet is heated when thermal transfer printing is conducted, it is preferable that the substrate sheet have mechanical strength to such a degree that the substrate sheet even in a heated state can be handled without undergoing any trouble.

There is no particular limitation on the material of the substrate sheet, and any of the following materials can be used: for example, condenser paper, glassine paper, parchment paper, paper having a high size content, synthetic paper (polyolefin type, polystyrene type, etc.), high-quality paper, art paper, coated paper, cast-coated paper, wallpaper, backing paper, paper impregnated with a synthetic resin or emulsion, paper impregnated with a synthetic rubber latex, paper containing a synthetic resin, cardboard, cellulose fiber paper, and sheets or films of plastics such as polyester, polyacrylate, polycarbonate, polyurethane, polyimide, polyetherimide, cellulose derivatives, polyethylene, ethylene-vinyl acetate copolymers, polypropylene, polystyrene, acryl, polyvinyl chloride, polyvinylidene chloride, polyvinyl alcohol, polyvinyl butyral, nylon, polyether ether ketone, polysulfone, polyether sulfone, tetrafluoroethyleneperfluoroalkylvinyl ether, polyvinyl fluoride, tetrafluoroethylene-ethylene, tetrafluoroethylenehexafluoropropylene, polychlorotrifluoroethylene and polyvinylidene fluoride.

Further, of the above-enumerated synthetic papers and plastic films, those which contain therein microvoids can also be used. A plastic film or synthetic paper having microvoids can be obtained by forming a film by the use of a mixture of a polyolefin, in particular, polypropylene and an inorganic pigment, and stretching the film. A particularly preferable plastic film or synthetic paper is one obtained by blending an inorganic pigment and/or polypropylene with a polymer which is incompatible therewith, forming a film by the use of the resulting compound in which the polypropylene and/or the inorganic pigment serve as a foaming agent, and stretching the film.

The above-described plastic film or synthetic paper may be composed of either a single layer or a plurality of layers containing microvoids. In the latter case, the microvoids way be contained either in each of the layers composing the plastic film or synthetic paper, or in only some of the layers. A white pigment may be incorporated as a hiding agent into this plastic film or synthetic paper, if necessary. Further, in order to increase the whiteness of the plastic film or synthetic papers additives such as a fluorescent whitening agent can also be added. Furthermore, a skin layer may be provided on the surface of the plastic film or synthetic paper in order to impart thereto brightness and smoothness. The thickness of the plastic film or synthetic paper is preferably from 30 to 80 micrometers.

A laminate obtained by the combination use of any of the above-described sheets and film is can also be used as the substrate sheet. Typical examples of the laminate include laminated paper consisting of cellulose fiber paper and synthetic paper, and cellulose fiber paper laminated with a plastic film or sheet. Such laminated synthetic paper may be composed of two layers. However, a laminate composed of three or more layers, obtained by laminating synthetic paper or a plastic film on both surfaces of the substrate sheet in order to improve the feeling or texture of the substrate sheet can also be used.

There is no limitation on the thickness of the substrate sheet. However, the thickness of the substrate sheet is, in general, from 10 to 300 micrometers. When the adhesion between the substrate sheet and a layer formed thereon is insufficient, it is preferable to treat the surface of the substrate sheet with various primers or corona discharge.

Intermediate Layer

An intermediate layer may be provided between the above-described substrate sheet and a dye-receiving layer to be formed thereon. The intermediate layer includes any layer which exists between the substrate sheet and the dye-receiving layer, and may be composed of a plurality of layers.

The functions of the intermediate layer are to impart solvent resistance, barrier properties, adhesive properties, whiteness, hiding properties, cushioning properties, antistatic properties and the like. Any conventionally-known intermediate layer can be used in the present invention.

In order to impart solvent resistance and barrier properties, it Is preferable to use a water-soluble resin. Examples of the water-soluble resin include cellulose resins (in particular, carboxymethyl cellulose), polysaccharides such as starch, proteins (in particular, casein), gelatin, agar-agar, vinyl resins such as polyvinyl alcohol, ethylene-vinyl acetate copolymers, vinyl acetate, vinyl chloride-vinyl acetate copolymers, vinyl acetate-(meth)acrylic copolymers, vinyl acetate-veoba copolymers, (meth )acrylic resin, styrene-(meth )acrylic copolymers and styrene resin, polyamide resins such as melamine resin, urea resin and benzoguanamine resin, polyester and polyurethane.

The water-soluble resin herein includes those resins which can be completely dissolved (particle diameter: 0.01 micrometers or less), colloidally dispersed (0.01 to 0.1 micrometers), emulsified (0.1 to 1 micrometer) or slurried (1 micrometer or more) in a solvent mainly composed of water.

Of these water-soluble resins, particularly preferable ones are those which are neither dissolved nor even swollen in a general-purpose solvent such as hexane, cyclohexane, acetone, methyl ethyl ketone, xylene, ethyl acetate, butyl acetate, toluene or an alcohol such as methanol, ethanol or IPA. In this sense, those resins which can be completely dissolved in a solvent mainly composed of water are most preferred, and polyvinyl alcohol and cellulose resins are particularly mentioned as such resins.

In order to impart adhesive properties, an intermediate layer made from a urethane, polyolefin or vinyl resin is usually provided, although it depends on the type of the substrate sheet and the surface treatment conducted on the substrate sheet. Further, excellent adhesive properties can be obtained by using a thermoplastic resin containing active hydrogen and a curing agent such as an isocyanate compound in combination. In order to impart whiteness, a fluorescent whitening agent van be used. Any conventionally-known fluorescent whitening agent can be used in the present invention. Examples of the fluorescent whitening agent include those of stilbene, distilbene, benzoxazole, styryl-oxazole, pyrene-oxazole, coumarin, aminocoumarin, imidazole, benzoimidazole, pyrazoline, distyryl-biphenyl and thiazole types. The whiteness can be controlled by changing the type and the amount of fluorescent whitening agent to be used.

Any method can be adopted as a method for incorporating the fluorescent whitening agent into the intermediate layer. Namely, a suitable method can be selected, depending upon the dissolving characteristics of a binder resin to be used, from a method in which a whitening agent dissolved in water or an organic solvent is added, a method in which a whitening agent pulverized and dispersed by a ball mill or colloid mill is added, a method in which a whitening agent dissolved in a solvent having a high boiling point is mixed with a hydrophilic colloidal solution and the oil-in-water-type dispersion thus obtained is added, and a method in which a whitening, agent impregnated in a polymer latex is added.

Titanium oxide may be added to the intermediate layer in order to hide the glaring or roughness of the substrate sheet. By this, the material of the substrate sheet can be selected more freely. There are two types of titanium oxides, that is, rutile-type titanium oxide and anatase-type titanium oxide. If the whiteness and the effects of the fluorescent whitening agent are taken into consideration, anatase-type titanium oxide, which absorbs ultraviolet light of a short wavelength as compared with rutile-type titanium oxide, is preferred. In the case where titanium oxide cannot be readily dispersed in a solution of a resin in an organic solvent or in an aqueous resin solution, the titanium oxide can be subjected, depending upon the solvent used, to a surface treatment to impart thereto hydrophilic nature, or dispersed by using a known dispersant such as a surface active agent or ethylene glycol.

It is preferable to add 10 to 300 parts by weight (solid basis) of titanium oxide for 100 parts by weight (solid basis) of the resin.

An intermediate layer having cushioning properties can be obtained, for instance, in the following manner: a plastic resin is mixed with a foaming agent such as microsphere, and the mixture is coated and heated to form microvoids. Any of conventionally-known resins such as polyester resins, urethane resins, polycarbonate resins, acrylic resins, polyvinyl chloride and polyvinyl acetate can be used either singly or in combination as the plastic resin. Alternatively, a layer made from a resin having a low glass transition temperature can be used such a layer can reveal cushioning properties by heat which is applied when heat transfer printing is conducted.

A layer having antistatic properties can be formed by using an antistatic resin such as acrylic resin, a filler and an antistatic agent selected from fatty acid esters, sulfuric esters, phosphoric esters, amides, quaternary ammonium salts, betaines, amino compounds, ethylene oxide addition products and the like. Alternatively, the above-described antistatic agent is added to any other layer to impart thereto antistatic properties.

Dye-Receiving Layer

The dye-receiving layer to be formed on the surface of the substrate sheet is a layer for receiving a sublimable dye which is transferred from a heat transfer sheet, and for supporting an image formed thereon. The dye-receiving layer comprises a thermoplastic resin, and at least two types of cured products of modified silicones whose curing mechanisms are different.

Alternatively, the dye-receiving layer is a layer comprising as a main component a thermoplastic resin, and a releasing layer comprising at least two types of cured products of modified silicones whose curing mechanisms are different is formed on the dye-receiving layer.

Examples of the thermoplastic resin used for forming the dye-receiving layer include halogenated polymers such as polyvinyl chloride and polyvinylidene chloride, vinyl resins such as polyvinyl acetate, ethylene-vinyl acetate copolymers, vinyl chloride-vinyl acetate copolymers, polyacrylic esters, polystyrene and polystyrene acrylate, acetal resins such as polyvinyl formal, polyvinyl butyral end polyvinyl acetal, saturated or unsaturated polyester resins, polycarbonate resins, cellulose resins such as cellulose acetate, polyolefin resins, and polyamide resins such as urea resin, melamine resin and benzoguanamine resin. Any two or more of these resins can be used as a mixture as long as they are compatible.

Among the above-described thermoplastic resins, those which contain an active hydrogen are preferred. It is preferable that the active hydrogen be present only at the terminal end(s) of the resin from the viewpoint of stability of the resin. In the case where a vinyl resin is used, the amount of vinyl alcohol is preferably 30% by weight or less.

When the active hydrogen content of the thermoplastic resin is too high, the resin is likely to be excessively cured by a curing agent, so that an image formed is to have a decreased density. In addition, the silicones cannot bleed out, and are cured and fixed inside the dye-receiving layer. For this reason, there may be a case where the surface of the dye-receiving layer cannot fully show release properties.

In the present invention, at least two curing-type modified silicones are used, and their curing mechanisms are different from each other. Silicones to be used in combination can be selected, in consideration of the merits and demerits of each of the silicones, so as to balance their properties. At least two silicone oils whose curing mechanisms are different from each other are used, and, if necessary, three or more silicone oils may be used.

Specific examples of the curing mechanism or reaction of a curing-type modified silicone include the reaction between an amino-modified silicone and an epoxy-modified silicone, the reaction between a modified silicone having an active hydrogen and a curing agent which can react with the active hydrogen, the polymerization of an addition-polymerizable silicone, the polymerization of a condensation-polymerizable silicone, and the curing of an active-energy-ray curing silicone. The term "active energy rays" herein includes ultraviolet rays, electron beam and heat rays. Any two or more curing mechanisms can be selected from the above-described ones.

It is preferable to select at least one curing mechanism from each of the following groups A and B:

Group A: Reaction between an amino-modified silicone and an epoxy-modified silicone. Reaction between a modified-silicone having an active hydrogen and a curing agent which can react with the active hydrogen.

Group B: Curing of an addition-polymerizable silicone. Curing of a condensation-polymerizable silicone. Curing of an active-energy-ray curing silicone.

It is particularly preferable to select, from the group A, the reaction between a modified silicone having an active hydrogen and a curing agent which can react with the active hydrogen, and, from group B, the curing of an addition-polymerizable silicone. Further, in this case, it is preferable to use, as the thermoplastic resin for forming the dye-receiving layer, the above-described thermoplastic resin having an active hydrogen.

The silicone having an active hydrogen forms a three-dimensional silicone-crosslinked structure by the curing agent which can react with the active hydrogen, and, when the thermoplastic resin has active hydrogen, the silicone is also combined with the thermoplastic resin to exhibit release properties.

This type of cured silicone shows extremely excellent release properties. However, it is necessary to conduct baking at a high temperature for many hours (120° C. or higher, 1 minute or longer) to carry out the curing reaction, so that the substrate sheet tends to be thermally shrunk or roughened. Moreover, since many hours are needed to complete the curing reaction, the productivity is low. When baking is conducted at a low temperature in a short time (120° C.–100° C., 1 minute–10 seconds), although the dye-receiving layer obtained can well stand for scratching and shows high mar resistance and excellent release properties, there may be observed such abnormal transfer printing that a binder is transferred from a heat transfer sheet to the dye-receiving layer together with a dye when the highlighted area of a monotonous, gradational image is formed.

On the other hand, when en addition-polymerizable silicone is cured, baking can be conducted at a relatively low temperature (120° C.–100° C.), and the curing reaction proceeds in a short time (1 minute–10 seconds). However, the dye-receiving layer obtained is to have low mar resistance. Further, when the silicone is added in such an amount that will not adversely affect the density of an image to be formed (5 parts by weight or less for 100 parts by weight of the resin), release properties cannot be sufficiently obtained, so that three-color printing cannot be successfully attained. In addition, there may also be observed such abnormal transfer printing that a binder is transferred from a heat transfer sheet to the dye-receiving layer together with a dye when the highlighted area of a monotonous image is formed.

Further, it is common that an addition-polymerizable silicone is cured in the presence of a catalyst. It has been known that almost all complexes of a transition metal selected from the iron and platinum groups in the group VIII are effective as the curing catalysts. However, a platinum compound is, in general, most efficient, and a platinum catalyst which is a platinum complex soluble in silicone oil Is preferably used. The amount of the catalyst needed for the reaction is approximately 1 to 100 ppm.

This platinum catalyst strongly interacts with an organic compound containing N, P, S or the like, a heavy metal ionic compound containing Sn, Pb, Hg, Bi, As or the like, and an organic compound containing a multiple bond such as acetylene group. Therefore, when the platinum catalyst is used along with any of the above-described compounds (catalytic poison), it loses its hydroxylating ability, and cannot act as a curing catalyst. As a result, the silicone cannot be cured completely ("Silicone Handbook" published by The Nikkan Kogyo Shimbun, Ltd.). Even if such an imperfectly-cured addition-polymerizable silicone is present in a dye-receiving layer, the dye-receiving layer cannot show release properties at all.

According to the present invention, an isocyanate compound may be used as the curing agent which can react with an active hydrogen. However, an isocyanate compound, and an organic tin compound which serves as the catalyst for it are catalytic poisons for the platinum catalyst, so that an addition-polymerizable silicone has never been used together with an isocyanate compound. Therefore, a silicone of this type has never been used along with a modified silicone having an active hydrogen which shows release properties when cured with an isocyanate compound.

It has now been found that an addition-polymerizable silicone can be successfully cured by 1) controlling the equivalent ratio of the reactive groups in the curing agent which can react with active hydrogen to the reactive groups in the thermoplastic resin and in the modified silicone having active hydrogen to from 1:1 to 10:1, and 2) using a platinum catalyst in an amount of 100 to 10000 ppm (platinum atom basis) of the addition-polymerizable silicone.

When the above equivalent ratio is less than 1, the degree of curing is so low that excellent release properties cannot be obtained. On the other hand, when the ratio is more than 10, the pot life of a coating liquid for forming a dye-receiving layer is so short that the coating liquid cannot be practically used.

Further, when the amount of the platinum catalyst is less than 100 ppm, the catalyst loses its activity due to the catalytic poison. On the other hand, when the amount of the platinum catalyst is more than 10000 ppm, the pot life of a coating liquid for forming a dye-receiving layer is so short that the coating liquid cannot be practically used.

As described above, when the mechanism in which curing is conducted by the reaction between a modified silicone having an active hydrogen and a curing agent which can react with the active hydrogen, and the mechanism in which an addition-polymerizable silicone is cured are selected, a dye-receiving layer having high mar resistance and excellent release properties can be obtained at a low temperature in a short time (120° C.–100° C., 1 minute–10 seconds). Since the dye-receiving layer has such properties, it is hardly marred, and a binder is not transferred from a heat transfer sheet to the dye-receiving layer together with a dye when the highlighted area of a monotonous image is formed.

The modified silicone having an active hydrogen herein include a hydroxyl-modified silicone, a carboxyl-modified silicone and an amino-modified silicone which are represented by the following formula (1) as described in "Handbook" published by The Nikkan Kogyo Shimbun, Ltd.:

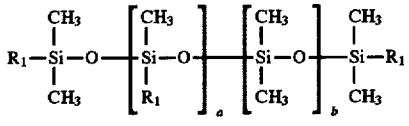

(1)

wherein $R_1$s represent $CH_3$ and $(CH_2)_mOH$ in the case of a hydroxyl-modified silicone, $CH_3$ and $(CH_2)_nCOOH$ in the case of a carboxyl-modified silicone, and $CH_3$ and $C_3H_6NH_2$ in the case of an amino-modified silicone. The methyl groups in each of the above-modified silicones may be replaced with ethyl, phenyl or 3,3,3-trifluoropropyl groups.

Of these modified silicones, a hydroxyl-modified silicone is most preferable from the viewpoint of reactivity.

In the case where any of the above modified silicones is used together with the above-described thermoplastic resin for forming a dye-receiving layer, it is more preferable to partially replace the methyl groups in the modified silicone with phenyl groups so as to improve the compatibility of the silicone with the thermoplastic resin. The preferable rate of the replacement with phenyl groups is 1) from 0 to 20 mol % of all of the methyl groups in each of the modified silicones represented by the above structural formula when the thermoplastic resin contains from 0.01 to 0.1 mol/100 g of active hydrogen, and 2) from 0 to 50 mol % of all of the methyl groups in each of the modified silicones represented by the above structural formula when the thermoplastic resin contains from 0.1 to 0.4 mol/100 g of active hydrogen. When the rate of the replacement exceeds the above range, the releasability of the image-receiving sheet from a heat transfer sheet upon heat transfer printing is lowered. In this case, when the amount of the silicone is made large so as to improve release properties, an image formed is to have a decreased density.

Further, it is preferable that the rate of the replacement with phenyl groups be 5 mol % or more, provided that the upper limit of the rate is as described above. This is because when the rate of the replacement with phenyl groups is too low, the surface of the dye-receiving layer becomes too slippery, causing troubles upon feeding and discharging the image-receiving sheet in a printer.

The addition-polymerizable silicone for use in the present invention is a mixture of a vinyl-modified silicone and a hydrogen-modified silicone. It has been known that almost all complexes of a transition metal selected from the iron and platinum families in the group VIII are effective as curing catalysts in the curing reaction. However, a platinum compound is, in general, most efficient, and a platinum catalyst which is a platinum complex soluble in silicone oil is preferred.

In order to control the curing speed of the addition-polymerizable silicone and the stability of the silicone in a coating liquid for forming a dye-receiving layer, a reaction retarder may further be added, if necessary. The known structural formulas of a vinyl-modified silicone and of a hydrogen-modified silicone are as follows ("Handbook" published by The Nikkan Kogyo Shimbun, Ltd.):

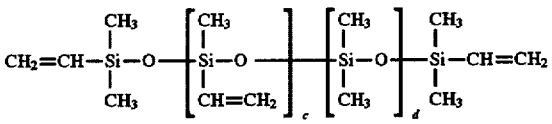

(2)

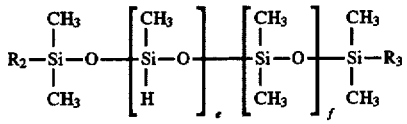

(3)

wherein $R_2$ and $R_3$ represent $CH_3$ and H.

The methyl groups in the vinyl-modified silicone and the hydrogen-modified silicone represented by the above structural formulas may be replaced with ethyl, phenyl or 3,3,3-trifluoropropyl groups.

Further, in the case where the silicone is used together with the thermoplastic resin for forming a dye-receiving layer, it is preferable to partially replace the methyl groups in the silicone with phenyl groups so as to improve the compatibility of the silicone with the thermoplastic resin. The rate of the replacement with phenyl groups is preferably 10 to 60% of all of the methyl groups in each of the silicones represented by the above structural formulas.

The molecular weight of the above-described various types of modified silicones, in particular, that of the modified silicone having an active hydrogen or of the addition-polymerizable silicone is preferably in the range of 1000 to 40000 when the reactivity of the silicone and the compatibility with a binder resin are taken into consideration. When the molecular weight is less than 1000, the silicone is often poorly cured; and when it is in excess of 40000, the compatibility of the silicone with a binder resin is likely to be poor.

Further, the amount of the various types of modified silicones, in particular, that of the silicone having an active hydrogen or of the addition-polymerizable silicone is preferably from 0.1 to 10 parts by weight, more preferably from 1 to 5 parts by weight for 100 parts by weight (solid basis) of the thermoplastic resin contained in the dye-receiving layer. When the amount of the silicone is smaller then the above range, release properties are likely to be poor, and when it is larger than the above range, the density of a printed image is likely to be low.

The curing agent for use in the present invention, capable of reacting with an active hydrogen is an isocyanate compound or a chelate compound, and a non-yellowing isocyanate compound is particularly preferred. Specific examples of the curing agent include XDI, hydrogenated XDI, TMXDI, HDI and edducts/biurets, oligomers and prepolymers thereof. In addition to these compounds, any isocyanate compound which can cause reaction within the time required for evaporating a solvent contained in a coating liquid for forming a dye-receiving layer can be used as long as it is of the non-yellowing type. Specifically, those non-yellowing isocyanate compounds which can cause reaction within two minutes at a temperature of 100° to 120° C. are preferred.

A catalyst may be added as an auxiliary agent for the isocyanate compound, and any known catalyst can be used. Di-n-butyltin dilaurate (DBTDL), a tin catalyst, can be mentioned as the typical catalyst. Beside this catalyst, dibutyltin fatty acid salt catalysts, monobutyltin fatty acid salt catalysts, dioctyltin fatty acid salt catalysts, monooctyltin fatty acid salt catalysts, and dimers thereof are useful. When the amount of tin per weight is larger, the reaction rate becomes higher. Therefore, the type, combination and amount of the catalyst can be selected depending upon the isocyanate compound used.

Further, when a block-type isocyanate compound is used, the combination use of such an isocyanate compound with a block-dissociating catalyst is also effective.

Releasing Layer

A releasing layer made from the above mentioned modified silicone oils can be provided on the surface of the dye-receiving layer, instead of incorporating the silicone oils into the dye-receiving layer. In this case, the dye-receiving layer may be either a layer formed by using one or more of the previously-mentioned thermoplastic resins, or a layer formed by using the thermoplastic resin(s) and the curing-type modified silicones.

This releasing layer comprises at least two types of cured products of the curing-type modified silicones. The type of the silicones to be used and the manner of using the silicones are the same as those described above. Further, when a catalyst or a retarder is used, the kind thereof and manner of using it are also the same as those described above.

The releasing layer can be formed either by using the silicones only, or by using the silicones and a binder resin which is compatible with the silicones.

The thickness of the releasing layer is approximately 0.001 to 1 g/m$^2$.

Treatment of Outermost Surface

The outermost surface of the image-receiving surface may be subjected to any of various surface treatments such as antistatic treatment, calendering treatment and embossing treatment unless the properties of the dye-receiving layer (and the releasing layer when formed) are impaired.

Backing Layer

In order to more smoothly carry the heat transfer image-receiving sheet in a printer, to prevent the image-receiving sheet from being curled, or to impart antistatic properties to the image-receiving sheet, a backing layer may be provided on the back surface of the image-receiving sheet. In order to more smoothly carry the image-receiving sheet, it is preferable to add a suitable amount of an organic or inorganic filler to a binder resin, or to use a resin having high slip properties, such as a polyolefin or cellulose resin.

In order to impart antistatic properties to the image-receiving sheet, an electroconductive resin such as acrylic resin, a filler, and an antistatic agent selected from fatty acid esters, sulfuric esters, phosphoric esters, amides, quaternary ammonium salts, betaines, amino compounds, ethylene oxide addition products and ionic compounds may be incorporated into the backing layer. Alternatively, an antistatic layer comprising the above components may be provided either on top of the backing layer or between the backing layer and the substrate sheet.

The amount of the antistatic agent to be used varies depending upon the layer to which the antistatic agent is added and the type of the antistatic agent. It is anyway preferable to control the electric resistance on the surface of the heat transfer image-receiving sheet to $10^{14}$ ohm/cm$^2$ or less. When the surface electric resistance is higher than $10^{14}$ ohm/cm$^2$, two pieces of the heat transfer image-receiving sheet tend to adhered to each other due to static electricity. A trouble on paper feed is thus caused. The amount of the antistatic agent used is preferably from 0.001 to 3.0 g/m$^2$. When the amount of the antistatic agent is less than 0.001 g/m$^2$, antistatic effects cannot be fully obtained. On the other hand, to use more than 3.0 g/m$^2$ of the antistatic agent is uneconomical. Further, when the antistatic layer is provided on the outermost surface of the backing layer, such a trouble as sticking may be caused.

EXAMPLES

Silicones used in the following examples are as follows:

Silicone 1:

Hydroxyl-modified silicone represented by the chemical formula (1) in which R1s at both terminal ends represent $CH_3$, and $R_1$ as a side chain represents $(CH_2)_2OH$.

Rate of replacement of methyl groups with phenyl groups: 22 mol %; equivalent of OH: approximately 0.25 mol/100 g; and molecular weight: approximately 2000.

Silicone 2:

Carboxyl-modified silicone represented by the chemical formula (1) in which R1s at both terminal ends represent $CH_3$, and $R_1$ as a side chain represents $(CH_2)_2COOH$. Rate of replacement of methyl groups with phenyl groups: 22 mol %; equivalent of carboxyl: approximately 0.25 mol/100 g; and molecular weight: approximately 2000.

Silicone 3:

Amino-modified silicone represented by the chemical formula (1) in which $R_1$ s at both terminal ends represent $CH_3$, and $R_1$ as a side chain represents $C_3H_6NH_2$. Rate of replacement of methyl groups with phenyl groups: 22 mol %; equivalent of amino: approximately 0.25 mol/100 g; and molecular weight: approximately 2000.

Silicone 4:

Addition-polymerizable silicone obtained by blending 1 part by weight of a vinyl-modified silicone represented by the chemical formula (2) and 2 parts by weight of a hydrogen-modified silicone represented by the chemical formula (3). Rate of replacement of methyl groups with phenyl groups in each of the silicones: 30 mol %; molecular weight of each of the silicones: approximately 7000; amount of reactive groups in the vinyl-modified silicone: approximately 15 mol %; $R_2$ and $R_3$ at both terminal ends of the hydrogen-modified silicone: $CH_3$ and H; and amount of reactive groups in the hydrogen-modified silicone: approximately 30 mol %.

The present invention will now be explained more specifically by referring to the following Examples and Comparative Examples. Throughout these examples, the quantities expressed in "part(s)" or "%" are on weight basis, unless otherwise specified.

Example 1

Synthetic paper "YUPO FPG#150" having a thickness of 150 micrometers, manufactured by Oji-Yuka Synthetic Paper Co., Ltd. was used as the substrate sheet. A coating liquid having the following formulation was coated in an amount of 4.0 g/m$^2$ on dry basis onto one surface of the substrate sheet by means of a wire bar, dried at 110° C. for 30 seconds, and allowed to stand at room temperature for 12 hours or longer to obtain a heat transfer image-receiving sheet of the present invention.

| Coating Liquid for Forming Dye-Receiving Layer | |
|---|---|
| Polyester resin ("Vylon 200" manufactured by Toyobo Co., Ltd.) | 100 parts |
| Hydroxyl-modified silicone (Silicon 1) | 1 part |
| Isocyanate compound ("Takenate A-14" manufactured by Takeda Chemical Industries, Ltd.) | 5 parts |
| Tin catalyst (di-n-butyltin dilaurate; manufactured by Tokyo Kasei Kogyo Co., Ltd.) | 0.2 parts |
| Addition-polymerizable silicone (Silicone 4) | 3 parts |

-continued

| Coating Liquid for Forming Dye-Receiving Layer | |
|---|---|
| Platinum catalyst ("CAT-PL-50T" manufactured by Shin-Etsu Chemical Co., Ltd.) | 2 parts |
| Reaction retarder ("CAT-PLR-5" manufactured by Shin-Etsu Chemical Co., Ltd.) | 1.5 parts |
| Methyl ethyl ketone/toluene = 1/1 (weight basis) | 400 parts |

Example 2

A heat transfer image-receiving sheet of the present invention was prepared in the same manner as in Example 1, provided that the coating liquid used in Example 1 was replaced with a coating liquid having the following formulation.

| Coating Liquid for Forming Dye-Receiving Layer | |
|---|---|
| Polyester resin ("Vylon 200" manufactured by Toyobo Co., Ltd,) | 100 parts |
| Hydroxyl-modified silicon (Silicone 1) | 3 parts |
| Chelate compound ("Orgatics TC-100" manufactured by Matsumoto Trading Co., Ltd.) | 5 parts |
| Addition-polymerizable silicone (Silicone 4) | 5 parts |
| Platinum catalyst ("CAT-PL-50T" manufactured by Shin-Etsu Chemical Co. Ltd.) | 2 parts |
| Reaction retarder ("CAT-PLR-5" manufactured by Shin-Etsu Chemical Co., Ltd.) | 1.5 parts |
| Methyl ethyl ketone/toluene = 1/1 (weight basis) | 400 parts |

Example 3

A heat transfer image-receiving sheet of the present invention was prepared in the same manner as in Example 1, provided that the coating liquid used in Example 1 was replaced with a coating liquid having the following formulation.

| Coating Liquid for Forming Dye-Receiving Layer | |
|---|---|
| Polyester resin ("Vylon 200" manufactured by Toyobo Co., Ltd.) | 100 parts |
| Carboxyl-modified silicone (Silicone 2) | 5 parts |
| Isocyanate compound ("Takenate A-14" manufactured by Takeda Chemical Industries Ltd.) | 5 parts |
| Tin catalyst (di-n-butyltin dilaurate; manufactured by Tokyo Kasei Kogyo Co. Ltd.) | 0.2 parts |
| Addition-polymerizable silicone (Silicone 4) | 4 parts |
| Platinum catalyst ("CAT-PL-50T" manufactured by Shin-Etsu Chemical Co., Ltd.) | 2 parts |
| Reaction retarder ("CAT-PLR-5" manufactured by Shin-Etsu Chemical Co., Ltd.) | 2 parts |
| Methyl ethyl ketone/toluene = 1/1 (weight basis) | 400 parts |

Example 4

A heat transfer image-receiving sheet of the present invention was prepared in the same manner as in Example 1, provided that the coating liquid used in Example 1 was replaced with a coating liquid having the following formulation.

| Coating Liquid for forming Dye Receiving Layer | |
|---|---|
| Polyester resin ("Vylon 200" manufactured by Toyobo Co., Ltd.) | 100 parts |
| Amino-modified silicone (Silicone 3) | 5 parts |
| Chelate compound ("Orgatics TC-100" manufactured by Matsumoto Trading Co., Ltd.) | 5 parts |
| Addition-polymerizable silicone (Silicone 4) | 3 parts |
| Platinum catalyst ("CAT-PLR-50T" manufactured by Shin-Etsu Chemical Co., Ltd.) | 2 parts |
| Reaction retarder ("CAT-PL-5" manufactured by Shin-Etsu Chemical Co., Ltd.). | 1.5 parts |
| Methyl ethyl ketone/toluene = 1/1 (weight basis) | 400 parts |

Example 5

A heat transfer image-receiving sheet of the present invention was prepared in the same manner as in Example 1, provided that the coating liquid used in Example 1 was replaced with a coating liquid having the following formulation.

| Coating Liquid for Forming Dye-Receiving Layer | |
|---|---|
| Vinyl chloride-vinyl acetate copolymer resin ("#1000A" manufactured by Denki Kagaku Kogyo K.K.) | 100 parts |
| Amino-modified silicone ("KF-393" manufactured by Shin-Etsu Chemical Co., Ltd.) | 3 parts |
| Epoxy-modified silicone ("X-22-343" manufactured by Shin-Etsu Chemical Co., Ltd.) | 3 parts |
| Addition-polymerizable silicone (Silicone 4) | 3 parts |
| Platinum catalyst ("CAT-PL-50T" manufactured by Shin-Etsu Chemical Co., Ltd.) | 2 parts |
| Reaction retarder ("CAT-PLR-5" manufactured by Shin-Etsu Chemical Co., Ltd.) | 1.5 parts |
| Methyl ethyl ketone/toluene = 1/1 (weight basis) | 400 parts |

Example 6

A heat transfer image-receiving sheet of the present invention was prepared in the same manner as in Example 1, provided that the coating liquid used in Example 1 was replaced with a coating liquid having the following formulation.

| Coating Liquid for Forming Dye-Receiving Layer | |
|---|---|
| Acrylic resin ("BR-52" manufactured by Mitsubishi Rayon Co., Ltd.) | 100 parts |
| Polyester resin ("Vylon 200" manufactured by Toyobo Co., Ltd.) | 100 parts |
| Hydroxy-modified silicone (Silicone 1) | 3 parts |
| Isocyanate compound ("Takenate A-14" manufactured by Takeda Chemical Industries, Ltd.) | 5 parts |
| Tin catalyst (di-n-butyltin dilaurate; manufactured by Tokyo Kasei Kogyo Co., Ltd.) | 0.2 parts |
| Condensation-polymerizable silicone ("KS705F" manufactured by Shin-Etsu Chemical Co., Ltd.) | 12 parts |

-continued

| Coating Liquid for Forming Dye-Receiving Layer | |
|---|---|
| Catalyst ("CAT-PS-1" manufactured by Shin-Etsu Chemical Co., Ltd.) | 2 parts |
| Methyl ethyl ketone/toluene = 1/1 (weight basis) | 400 parts |

Example 7

A heat transfer image-receiving sheet of the present invention was prepared in the same manner as in Example 1, provided that the coating liquid used in Example 1 was replaced with a coating liquid having the following formulation and that 150 mJ/cm$^2$ of ultraviolet light having a dominant wavelength of 365 nm was applied to the dye-receiving layer after the layer was dried.

| Coating Liquid for Forming Dye-Receiving Layer | |
|---|---|
| Butyral resin ("BX-1" manufactured by Sekisui Chemical Co., Ltd.) | 100 parts |
| Hydroxyl-modified silicone (Silicone 1) | 3 parts |
| Isocyanate compound ("Takenate A-14" manufactured by Takeda Chemical Industries, Ltd.) | 5 parts |
| Tin catalyst (di-n-butyltin dilaurate; manufactured by Tokyo Kasei Kogyo Co., Ltd.) | 0.2 parts |
| Active-energy-ray-curing silicone ("KS5508" manufactured by Shin-Etsu Chemical Co., Ltd.) | 7 parts |
| Catalyst ("CAT-PL-5000" manufactured by Shin-Etsu Chemical Co., Ltd.) | 0.35 parts |
| Methyl ethyl ketone/toluene = 1/1 (weight basis) | 400 parts |

Comparative Example 1

A comparative heat transfer image-receiving sheet was prepared in the same manner as in Example 1, provided that the coating liquid used in Example 1 was replaced with a coating liquid having the following formulation.

| Coating Liquid for Forming Dye-Receiving Layer | |
|---|---|
| Polyester resin ("Vylon 200" manufactured by Toyobo Co., Ltd.) | 100 parts |
| Hydroxyl-modified silicone (Silicone 1) | 3 parts |
| Isocyanate compound ("Takenate A-14" manufactured by Takeda Chemical Industries, Ltd.) | 5 parts |
| Tin catalyst (di-n-butyltin dilaurate; manufactured by Tokyo Kasei Kogyo Co., Ltd.) | 0.2 parts |
| Methyl ethyl ketone/toluene = 1/1 (weight basis) | 400 parts |

Comparative Example 2

A comparative heat transfer image-receiving sheet was prepared in the same manner as in Example 1, provided that the coating liquid used in Example 1 was replaced with a coating liquid having the following formulation.

| Coating Liquid for Forming Dye-Receiving Layer | |
|---|---|
| Polyester resin ("Vylon 200" manufactured by Toyobo Co., Ltd.) | 100 parts |
| Addition-polymerizable silicone (Silicone 4) | 3 parts |
| Platinum catalyst ("CAT-PL-50T" manufactured by Shin-Etsu Chemical Co., Ltd.) | 2 parts |
| Reaction retarder ("CAT-PLR-5" manufactured by Shin-Etsu Chemical Co., Ltd.) | 1.5 parts |
| Methyl ethyl ketone/toluene = 1/1 (weight basis) | 400 parts |

Comparative Example 3

A comparative heat transfer image-receiving sheet was prepared in the same manner as in Example 1, provided that the coating liquid used in Example 1 was replaced with a coating liquid having the following formulation.

| Coating Liquid for Forming Dye-Receiving Layer | |
|---|---|
| Polyester resin ("Vylon 200" manufactured by Toyobo Co., Ltd.) | 100 parts |
| Amino-modified silicone ("KF-393" manufactured by Shin-Etsu Chemical Co., Ltd.) | 3 parts |
| Epoxy-modified silicone ("X-22-343" manufactured by Shin-Etsu Chemical Co., Ltd.) | 3 parts |
| Methyl ethyl ketone/toluene = 1/1 (weight basis) | 400 parts |

Comparative Example 4

A comparative heat transfer image-receiving sheet was prepared in the same manner as in Example 1, provided that the coating liquid used in Example 1 was replaced with a coating liquid having the following formulation.

| Coating Liquid for Forming Dye-Receiving Layer | |
|---|---|
| Polyester resin ("Vylon 200" manufactured by Toyobo Co., Ltd.) | 100 parts |
| Condensation-polymerizable silicone ("KS705F" manufactured by Shin-Etsu Chemical Co., Ltd.) | 12 parts |
| Catalyst ("CAT-PS-1" manufactured by Shin-Etsu Chemical Co., Ltd.) | 2 parts |
| Methyl ethyl ketone/toluene = 1/1 (weight basis) | 400 parts |

Comparative Example 5

A comparative heat transfer image-receiving sheet was prepared in the same manner as in Example 1, provided that the coating liquid used in Example 1 was replaced with a coating liquid having the following formulation and that 150 mJ/cm$^2$ of ultraviolet light having a dominant wavelength of 365 nm was applied to the dye-receiving layer after the layer was dried.

| Coating Liquid for Forming Dye-Receiving Layer | |
|---|---|
| Polyester resin ("Vylon 200" manufactured by Toyobo Co., Ltd.) | 100 parts |
| Active-energy-ray-curing silicone ("KS5508" manufactured by Shin-Etsu Chemical Co., Ltd.) | 7 parts |

-continued

| Coating Liquid for Forming Dye-Receiving Layer | |
|---|---|
| Catalyst ("CAT-PL-5000" manufactured by Shin-Etsu Chemical Co., Ltd.) | 0.35 parts |
| Methyl ethyl ketone/toluene = 1/1 (weight basis) | 400 parts |

Heat Transfer Sheet

An ink composition for forming a dye layer, having the following formulation was prepared. 1.0 g/m$^2$ (dry basis) of the ink composition was coated by means of a wire bar onto the surface of a polyethylene terephthalate film having a thickness of 6 micrometers with its back surface imparted with heat resistance, and then dried to obtain a heat transfer sheet.

Ink Composition for Forming Dye Layer

Yellow dye represented by the following chemical formula (4):

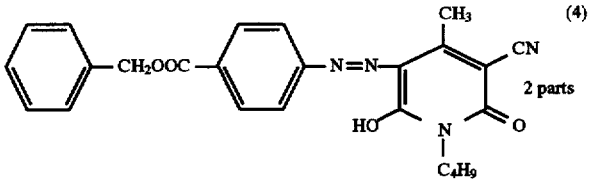

(4) 2 parts

Yellow dye represented by the following chemical formula (5):

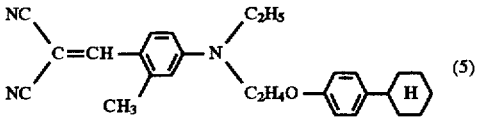

(5) 4 parts

| | |
|---|---|
| Polyvinyl butyral resin ("S-lec BX-1" manufactured by Sekisui Chemical Co., Ltd.) | 4 parts |
| Methyl ethyl ketone/toluene = 1/1 (weight basis) | 90 parts |

Methods of Evaluation

The results of the following tests for evaluation are shown in Table 1.

(1) Printing of Gradational Image

The above heat transfer sheet was superposed on each of the above-obtained heat transfer image-receiving sheets of the present invention and comparative ones with the dye layer and the dye-receiving layer faced with each other. Thermal energy was then applied to the back surface of the heat transfer sheet by a thermal head under the following conditions to obtain a yellow image:

electric voltage applied by the thermal head: 14.5 V, pulse width applied: adopted step pattern method, reduced from 6.4 msec/line at every 0.4 msec, and speed in sub-scanning direction: 6 line/mm (10 msec/line).

The highlighted-area of each of the images thus obtained was observed whether the binder was transferred from the heat transfer sheet to the image-receiving surface together with the dye.

Evaluation:

O: No abnormal transfer printing was observed.

X: The binder was transferred to the image-receiving surface together with the dye.

(2) Release Properties

A black solid image was printed by using a printer "VY-P1" manufactured by Hitachi, Ltd.

Evaluation:

O: No abnormal transfer printing was observed.

X: Such abnormal transfer printing that three-color printing could not be attained, that the dye-receiving layer was transferred to the heat transfer sheet, or that the binder was transferred to the image-receiving surface together with the dye was observed.

TABLE 1

| | Printing of Gradational Image | Release Properties | Total Evaluation |
|---|---|---|---|
| Example 1 | O | O | O |
| Example 2 | O | O | O |
| Example 3 | O | O | O |
| Example 4 | O | O | O |
| Example 5 | O | O | O |
| Example 6 | O | O | O |
| Example 7 | O | O | O |
| Comp. Ex. 1 | X | O | X |
| Comp. Ex. 2 | X | X | X |
| Comp. Ex. 3 | X | X | X |
| Comp. Ex. 4 | X | X | X |
| Comp. Ex. 5 | X | X | X |

By the present invention, it is possible to obtain a heat transfer image-receiving sheet which can be smoothly released from a heat transfer sheet without being thermally fused therewith when an image is formed and on which an image having high density can be formed.

Further, since the dye-receiving layer of the image-receiving sheet can be obtained by conducting drying at a low temperature, the substrate sheet is scarcely affected by heat. The substrate sheet is therefore neither thermally shrunk nor roughened. Further, the drying can be conducted in a short time, so that the heat transfer image-receiving sheet can be obtained with high productivity.

What is claimed is:

1. A heat transfer image-receiving sheet comprising:

a substrate sheet; and a dye-receiving layer provided at least on one surface of the substrate sheet and comprising a thermoplastic resin and at least two types of cured products of modified silicones whose curing mechanisms are different.

2. The heat transfer image-receiving sheet according to claim 1, wherein the cured products of modified silicones are selected from a reaction product between an amino-modified silicone and an epoxy-modified silicone, a reaction product between a modified silicone having an active hydrogen and a curing agent which can react with the active hydrogen, a cured product of an addition-polymerizable silicone, a cured product of a condensation-polymerizable silicone and a cured product of an active-energy-ray curing silicone.

3. The heat transfer image-receiving sheet according to claim 2, wherein the cured products of modified silicones are a reaction product between a modified silicone having an active hydrogen and a curing agent which can react with the active hydrogen, and a cured product of an addition-polymerizable silicone.

4. The heat transfer image-receiving sheet according to claim 3, wherein the modified silicone having an active hydrogen is a hydroxyl-modified silicone, a carboxyl-modified silicone or an amino-modified silicone.

5. The heat transfer image-receiving sheet according to claim 3, wherein the curing agent which reacts with the active hydrogen is an isocyanate compound or a chelate compound.

6. The heat transfer image-receiving sheet according to claim 5, wherein the equivalent ratio of the reactive groups in the curing agent to the reactive groups in the thermoplastic resin and in the modified silicone having an active hydrogen is from 1:1 to 10:1.

7. The heat transfer image-receiving sheet according to claim 5, wherein the isocyanate compound is of the XDI biuret type.

8. The heat transfer image-receiving sheet according to claim 5, wherein a tin catalyst is used as a curing catalyst for the isocyanate compound.

9. The heat transfer image-receiving sheet according to claim 1, wherein the thermoplastic resin has an active hydrogen.

10. The heat transfer image-receiving sheet according to claim 9, wherein the thermoplastic resin is an aromatic saturated polyester.

11. A heat transfer image-receiving sheet comprising:

a substrate sheet;

a dye-receiving layer provided at least on one surface of the substrate sheet and comprising a thermoplastic resin; and a releasing layer provided on the dye-receiving layer and comprising at least two types of cured products of modified silicones whose curing mechanisms are different.

12. The heat transfer image-receiving sheet according to claim 11, wherein the cured products of modified silicones are selected from a reaction product between an amino-modified silicone and an epoxy-modified silicone, a reaction product between a modified silicone having an active hydrogen and a curing agent which can react with the active hydrogen, a cured product of a condensation-polymerizable silicone and a cured product of an active-energy-ray curing silicone.

13. The heat transfer image-receiving sheet according to claim 12, wherein the cured products of modified silicones are a reaction product between a modified silicone having an active hydrogen and a curing agent which can react with the active hydrogen, and a cured product of an addition-polymerizable silicone.

14. The heat transfer image-receiving sheet according to claim 13, wherein the modified silicone having an active hydrogen is a hydroxyl-modified silicone, a carboxyl-modified silicone or an amino-modified silicone.

15. The heat transfer image-receiving sheet according to claim 13, wherein the curing agent which reacts with the active hydrogen is an isocyanate compound or a chelate compound.

16. The heat transfer image-receiving sheet according to claim 15, wherein the equivalent ratio of the reactive groups in the curing agent to the reactive groups in the thermoplastic resin and in the modified silicone having an active hydrogen is from 1:1 to 10:1.

17. The heat transfer image-receiving sheet according to claim 15, wherein the isocyanate compound is of the XDI biuret type.

18. The heat transfer image-receiving sheet according to claim 15, wherein a tin catalyst is used as a curing catalyst for the isocyanate compound.

19. The heat transfer image-receiving sheet according to claim 11, wherein the thermoplastic resin has an active hydrogen.

20. The heat transfer image-receiving sheet according to claim 19, wherein the thermoplastic resin is an aromatic saturated polyester.

21. A heat transfer image-receiving sheet comprising:

a substrate sheet;

a dye-receiving layer provided at least on one surface of the substrate sheet and comprising a thermoplastic resin; and releasing means provided in or on said dye-receiving layer, said releasing means comprising at least two types of cured products of modified silicones whose curing mechanisms are different.

* * * * *